US005598970A

United States Patent [19]

Mudry et al.

[11] Patent Number: 5,598,970

[45] Date of Patent: Feb. 4, 1997

[54] BUSINESS FORM OR MAILER INTERMEDIATE

[75] Inventors: Oleh B. Mudry, Spring Valley; Lawrence J. Schubert, Kettering; Hugh B. Skees, Dayton, all of Ohio

[73] Assignee: The Standard Register Company, Dayton, Ohio

[21] Appl. No.: 652,173

[22] Filed: May 23, 1996

Related U.S. Application Data

[63] Continuation of Ser. No. 388,303, Feb. 14, 1995, abandoned.

[51] Int. Cl.[6] ..... B65D 27/04

[52] U.S. Cl. ..... 229/305; 229/300; 229/314

[58] Field of Search ..... 229/70, 92.1, 92.3, 229/300, 304, 305, 314

[56] References Cited

U.S. PATENT DOCUMENTS

| | | | |
|---|---|---|---|
| 202,874 | 4/1878 | Rogers . | |
| 2,928,583 | 3/1960 | Law | 229/305 |
| 3,255,952 | 6/1966 | Black | 229/304 |
| 3,356,286 | 12/1967 | Greason | 229/70 |
| 3,507,519 | 4/1970 | McNabb | 229/305 X |
| 3,652,007 | 3/1972 | MacDougall | 229/304 |
| 3,693,869 | 9/1972 | Eaves, Jr. | 229/304 X |
| 4,487,360 | 12/1984 | Fisher et al. . | |
| 4,575,121 | 3/1986 | Conti . | |
| 4,754,915 | 7/1988 | Steidinger . | |
| 4,809,905 | 3/1989 | Goodman | 229/300 X |
| 5,048,748 | 9/1991 | Martin et al. . | |
| 5,096,229 | 3/1992 | Carlson . | |
| 5,131,686 | 7/1992 | Carlson . | |
| 5,169,060 | 12/1992 | Tighe et al. . | |
| 5,314,110 | 5/1994 | Lombardo . | |
| 5,346,123 | 9/1994 | Lombardo . | |
| 5,370,304 | 12/1994 | Sauerwine et al. . | |
| 5,375,764 | 12/1994 | Sauerwine . | |
| 5,464,255 | 11/1995 | Schildmeyer | 229/305 X |

*Primary Examiner*—Jes F. Pascua

*Attorney, Agent, or Firm*—Killworth, Gottman, Hagan & Schaeff

[57] ABSTRACT

A mailer or business form intermediate including a built-in reply envelope. The mailer comprises a single substrate sheet divided into four panels. At least three of the four panels are of substantially the same longitudinal dimension. The reply envelope is fashioned from the second and third panels upon folding. A closure flap for the reply envelope is also included. The mailer also contains provisions for including a number of partitions for labels or statements, a two-ply card, or a window for addresses.

12 Claims, 12 Drawing Sheets

BUSINESS FORM OR MAILER INTERMEDIATE

This application is continuation of application Ser. No. 08/388,303 filed Feb. 14, 1995, now abandoned.

BACKGROUND OF THE INVENTION

The present invention relates to a business form or mailer intermediate, and more particularly, to a mailer or business form having a built-in reply envelope which may be either duplex or simplex printed in either continuous or single sheet format.

Various mailer envelope styles have been developed for mailing bills, statements or the like to customers with features to ease the return mailing. Pre-addressed envelopes or labels have typically been included. Recently, mailers containing a built-in pre-addressed reply envelope have become increasingly popular. While such mailers have been for the most part successful, many varieties have encountered a number of difficulties, such as lacking the ability to be printed on both sides in a single pass through a continuous printing environment.

Lombardo, U.S. Pat. No. 5,346,123 discloses a mailer type business form and intermediate with a built-in reply envelope. The mailer of Lombardo is a sheet of four virtually identically sized panels which may be folded to form a four ply mailer. A return envelope is created from the first and fourth panels when the mailer is folded. The return envelope is open along the fourth panel with a sealing flap adjacent the outer edge of the fourth panel. Perforations are provided only in the second and third panels, not the first and fourth panels. Also, the Lombardo mailer does not provide return address labels or multiple invoice or billing statements and is simplex printed.

Accordingly, the need remains for an improved mailer or business form with a built-in reply envelope which may be either duplex or simplex printed in a continuous or single sheet format.

SUMMARY OF THE INVENTION

This need is met by the present invention whereby an improved mailer or business form intermediate including a built-in reply envelope is provided. The mailer of the present invention is made from a single sheet of double V-folded substrate. The mailer includes areas for the printing of variable or non-variable information. The mailer may be either simplex or duplex printed in a continuous or cut sheet format. Additionally, the mailer is easy to open and requires no additional steps by the end user to form the return envelope.

In accordance with one aspect of the present invention, a mailer or business form intermediate is provided. The mailer intermediate comprises a substrate sheet having first and second surfaces, first and second longitudinal edges and first and second opposing end edges. First, second and third transverse fold lines are formed in the substrate perpendicular to the parallel longitudinal edges thereby dividing the substrate into first, second, third, and fourth panels. The first fold line separates the first and second panels, the second fold line separates the second and third panels, and the third fold line separates the third and fourth panels. The second, third and at least one of the first and fourth panels have substantially the same longitudinal dimensions.

To secure the mailer intermediate in position, various adhesive patterns are employed. A first adhesive pattern is provided on the second surface of at least one of the second and third panels adjacent the longitudinal edges. A second adhesive pattern is provided on the second surface of at least one of the first and fourth panels also adjacent the longitudinal edges. A third adhesive pattern is provided on the first surface of at least one of the first and fourth panels. When the substrate is folded about the second fold line first, and then about the first and third fold lines, the adhesive patterns secure the mailer together. When folded, the second surfaces of the second and third panels lie in contact forming a reply envelope, the second surfaces of the first and fourth panels lie in contact, and the first surfaces of one of the first or fourth panels lie in contact with one of the second or third panels.

To form a return envelope closure flap, a transverse line of weakness is provided adjacent to either the first or third fold lines. A fourth adhesive pattern is disposed on the closure flap to allow the return envelope to be sealed. In addition, a fifth adhesive pattern may be disposed on the second surface of either the first or second end edges to help in sealing the mailer. Also, lines of weakness may be included in the first, second, third and fourth panels adjacent to both of the longitudinal edges, thereby allowing easy opening of the mailer. The transverse lines of weakness may be in either the first or fourth panels or alternatively in the second or third panels.

In a further embodiment of the present invention, a two-ply card may be included in the mailer. A line of weakness may be included in the first panel thereby defining a first ply. A line of weakness is then provided in the fourth panel defining a second ply. A sixth adhesive pattern is provided on the second surface of one or both of the first and second plies. Then, when the substrate is folded about the second fold line, the first ply and the second ply adhere to form a two-ply card.

In an alternative embodiment, horizontal and vertical lines of weakness may be provided in any of the first, second, third or fourth panels to define multiple sections. If so desired, a seventh adhesive pattern may be disposed on at least one of the sections thereby creating a label, for example a return address label. If so desired, the seventh adhesive pattern may be a pressure sensitive adhesive protected by a release liner. Alternatively, the seventh adhesive pattern may be a remoist adhesive as the fourth adhesive pattern may also preferably be. The first, second and third adhesive patterns are preferably self-adhesives (i.e., adhesives that will bond to themselves but not to other surfaces).

In additional embodiments of the present invention, one of either the first or fourth panels may have a longitudinal dimension which is less than the other and the second and third panels, or a return address window may be formed in either the first or fourth panels.

Accordingly, it is a feature of the present invention to provide a mailer or business form intermediate having a built-in reply envelope. It is a further feature of the present invention, to provide a mailer or business form intermediate wherein the mailer includes a two-ply card or a number of partitions. These, and other features and advantages of the present invention will become apparent from the following detailed description, the accompanying drawings and the appended claims.

DETAILED DESCRIPTION OF THE PREFERRED EMBODIMENTS

The present invention relates to a mailer or business form intermediate which contains a built-in reply envelope. The mailer contains four panels suitable for simplex or duplex printing of variable or non-variable information such as preprinted return addresses, billing statements, or a two-ply card. The printing may be accomplished with the various automated printers common today including impact, laser, thermal transfer and ink jet printers. The mailer can facilitate the return of mail solicitations by providing a pre-addressed, postage-paid return envelope or pre-printed return address labels. Further, the mailer is available in a continuous series in a folded pack or in single cut sheets.

Figure 1:
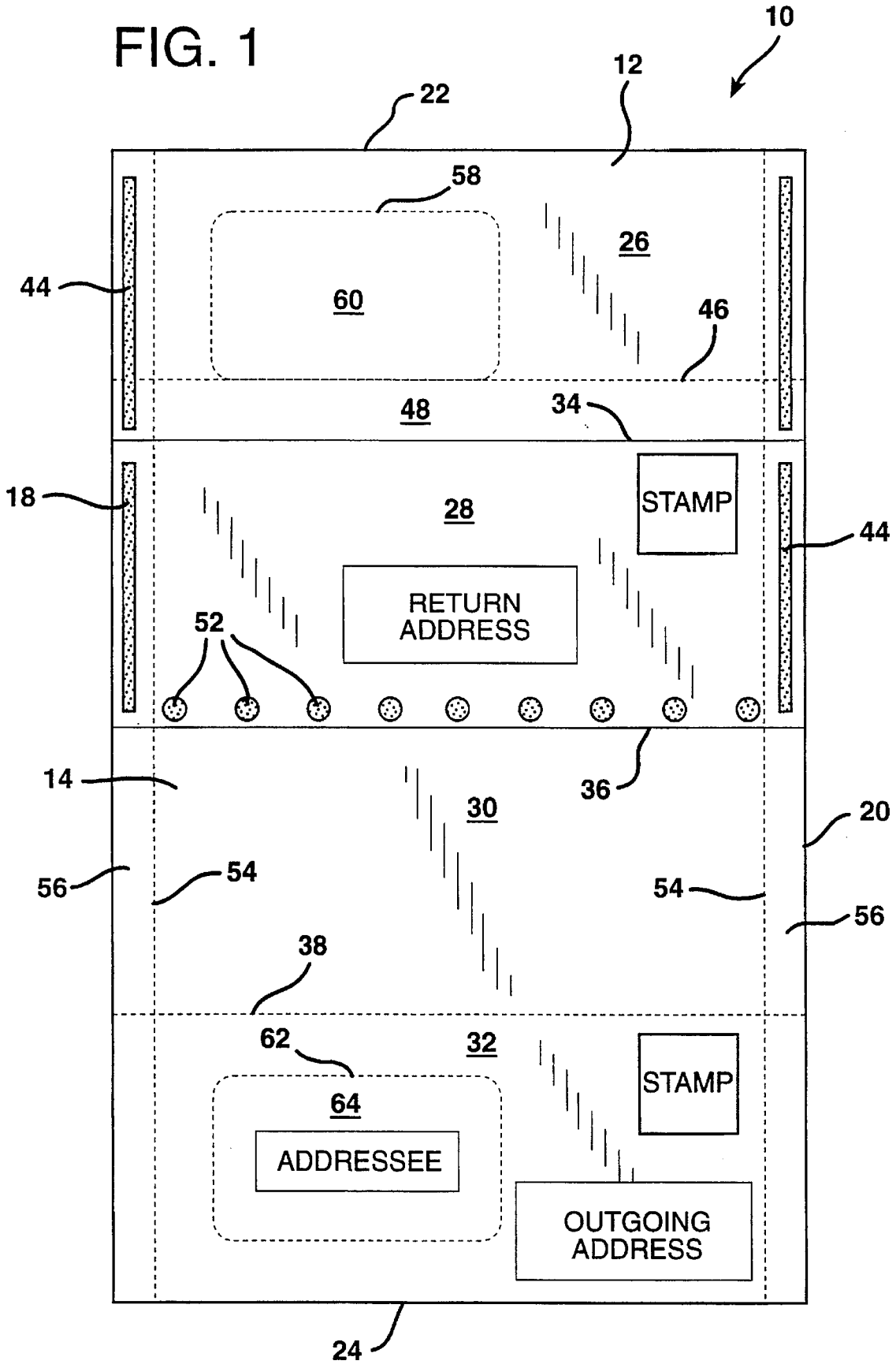
FIG. 1 is a plan view of the front (first) side of one embodiment of the mailer or business form intermediate of the present invention containing a two-ply card.
Figure 2:
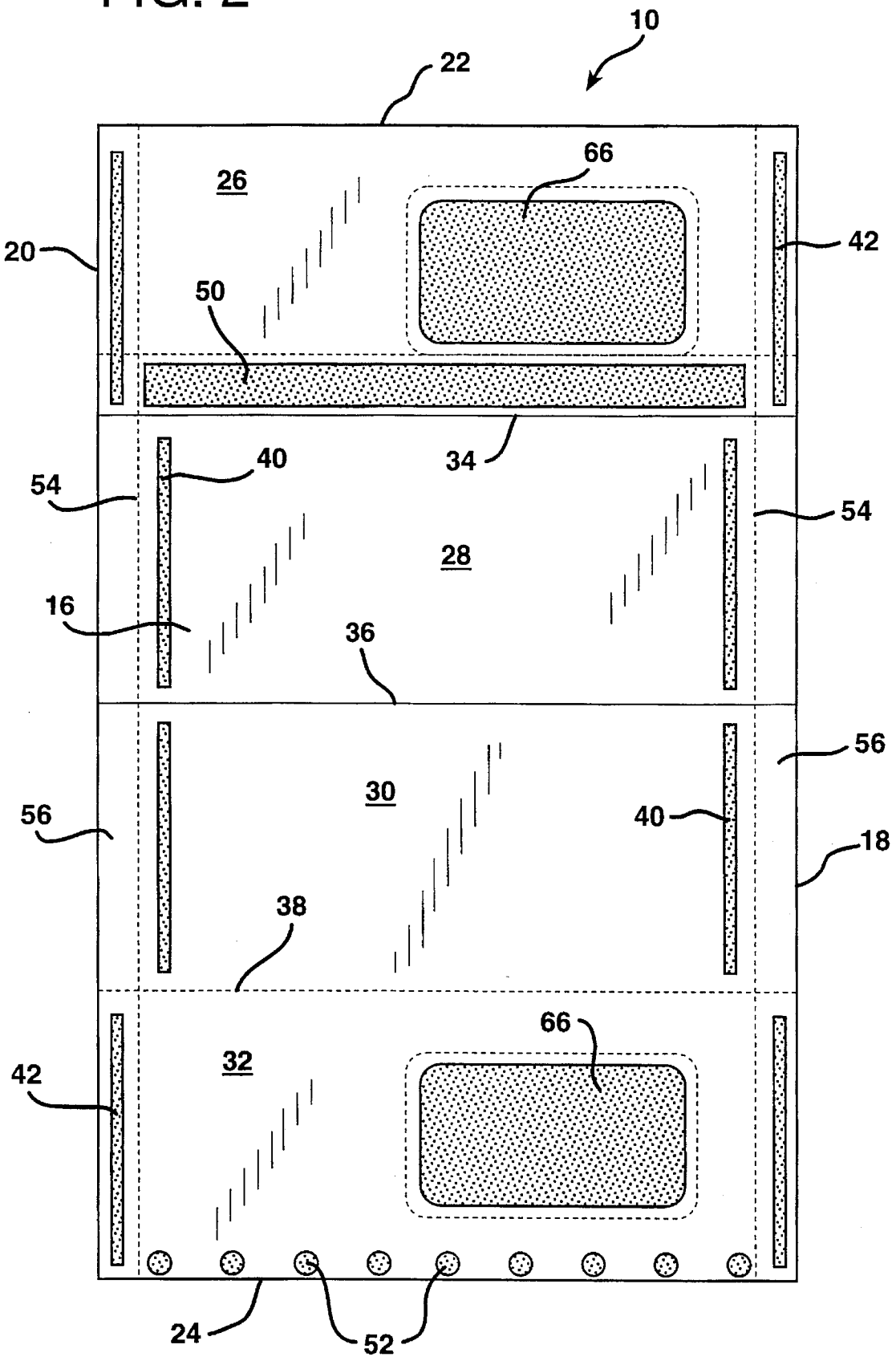
FIG. 2 is a plan view of the back (second) side of the embodiment shown in FIG. 1.

Although the mailer can be used for a variety of end uses, the invention will be explained with reference to the preferred embodiments as disclosed in the accompanying figures. Referring now to FIGS. 1 and 2, a first embodiment of the mailer intermediate of the present invention is shown. Mailer 10 includes a substrate sheet 12. Substrate sheet 12 may be of any known material common in the art for substrate purposes such as paper of various weights. Substrate sheet 12 includes first surface 14 and second surface 16, first longitudinal edge 18 and second longitudinal edge 20 and first end edge 22 and second end edge 24. First and second longitudinal edges, 18 and 20, respectively, are opposite and parallel each other. First and second end edges, 22 and 24, respectively, also are opposite one another.

Substrate 12 is divided into a first panel 26, a second panel 28, a third panel 30 and a fourth panel 32 by means of first fold line 34, second fold line 36 and third fold line 38. Either the first fold line 34 or the third fold line 38 may be a line of weakness, such as a partial die cut or a line of perforations, to facilitate removal of those panels by the user. First fold line 34 separates first panel 26 and second panel 28, second fold line 36 separates second panel 28 and third panel 30, and third fold line 38 separates third panel 30 and fourth panel 32.

Turning now to Pig. 5, there is seen the mailer 10 of the present invention. The mailer 10 of the present invention is a double V-fold mailer. That is, in order to create the mailer 10, substrate sheet 12 is folded first about second fold line 36 so that the second surface 16 of the first panel 26 and the fourth panel 32 lie in contact and the second surface 16 of the second panel 28 and the third panel 30 also lie in contact. The mailer 10 is then subjected to a second V-fold about the first fold line 34 and the third fold line 38 which also lie in contact. The mailer 10 is folded in the second fold so that the first surface 14 of the first panel 26 lies in contact with the first surface 14 of the second panel 28. Alternatively, the mailer may be folded in the second fold so that the first surface 14 of the fourth panel 32 lies in contact with the first surface 14 of the third panel 30. A number of adhesive patterns, described in detail below are then used to secure the mailer 10 together.

Figure 10:
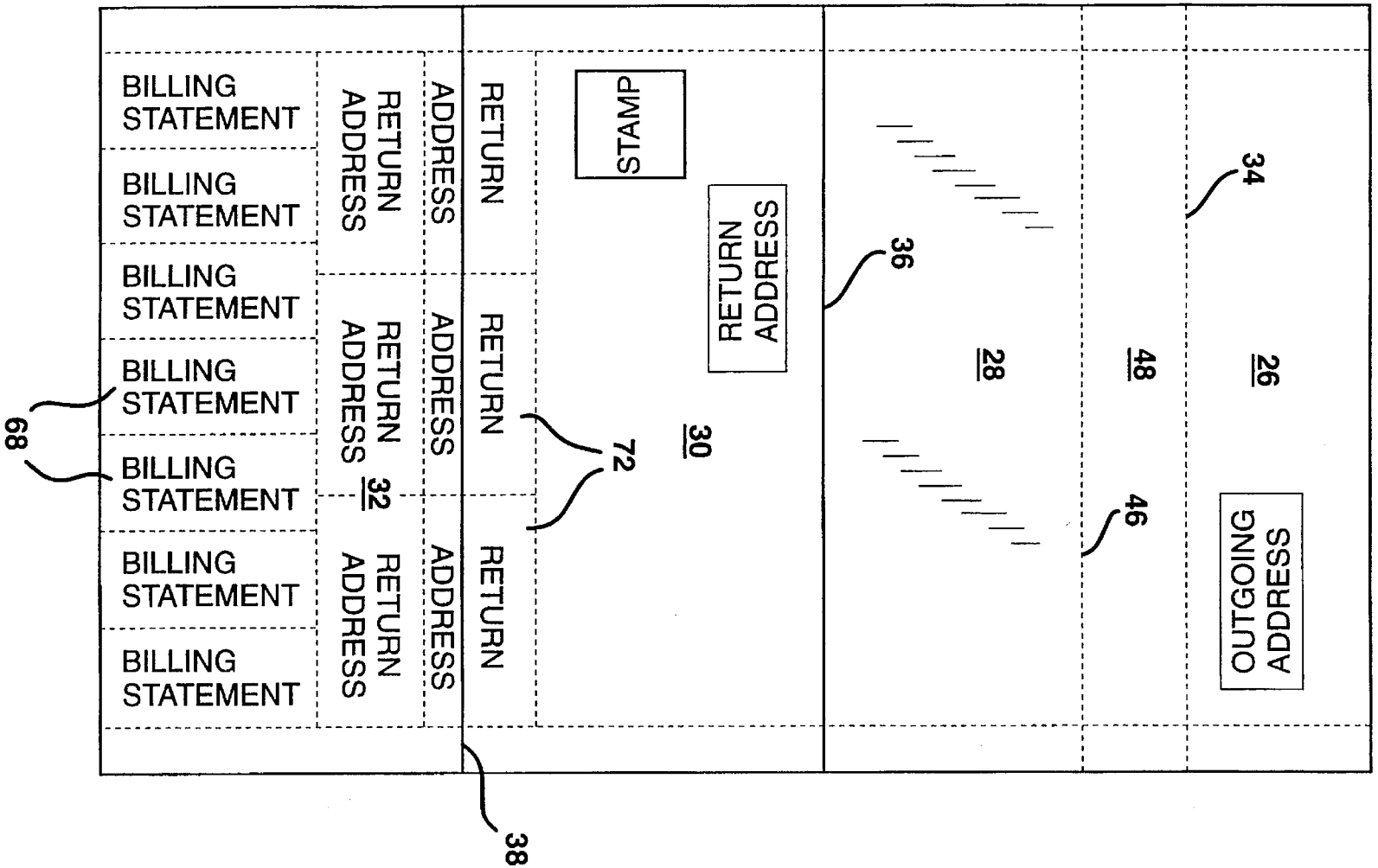
FIG. 10 is a plan view of one embodiment of the present invention of the mailer or business form of the present invention wherein a first panel is longitudinally smaller than the remaining three panels.

Returning to FIGS. 1 and 2, at least one of the first panel 26 or fourth panel 32 and both the second panel 28 and the third panel 30 are of substantially the same longitudinal dimensions. Thus, at least three of the four panels in the invention are preferably of the same longitudinal dimension. However, the remaining panel, either the first panel 26 or the fourth panel 32 may be of a smaller longitudinal dimension. For instance, either the fourth panel 32 may be either slightly smaller or, as shown in FIG. 10, may comprise an approximately half panel as the first panel 26 in FIG. 10. However, one of ordinary skill in the art will recognize that while the figures represent the preferred embodiment, the longitudinal dimension of the smaller panel may be any portion of a whole panel depending upon the desired end use.

A number of adhesive patterns are also disposed on substrate sheet 12 in order to secure the mailer 10 together once the mailer 10 is folded. In order to form the built-in reply envelope, a first adhesive pattern 40 is disposed on second surface 16 of at least one of the second or third panels, 28 and 30 respectively. Preferably, adhesive pattern 40 is disposed on both the second panel 28 and the third panel 30. Adhesive pattern 40 is disposed adjacent the first and second longitudinal edges 18 and 20. Thus, when the mailer 10 is folded first about the second fold line 36 as shown in FIG. 5 forming the first V-fold of the double V-fold mailer 10, the second surface 16 of the second panel 28 and the third panel 30 lie in contact with adhesive pattern 40 holding the panels together thereby forming a reply envelope (not shown).

A second adhesive pattern 42 is provided on the second surface 16 of at least one of the first and fourth panels, 26 and 32 respectively. Preferably, second adhesive pattern 42 is provided on both the first panel 26 and the fourth panel 32. Second adhesive pattern 42 is provided adjacent both the first and second longitudinal edges 18 and 20. Thus, when mailer 10 is folded first about second fold line 36 as in FIG. 5 forming the first fold of the double V-fold mailer 10, the second surface 16 of the first panel 26 and the fourth panel 32 lie in contact and are adhered to one another.

Figure 5:
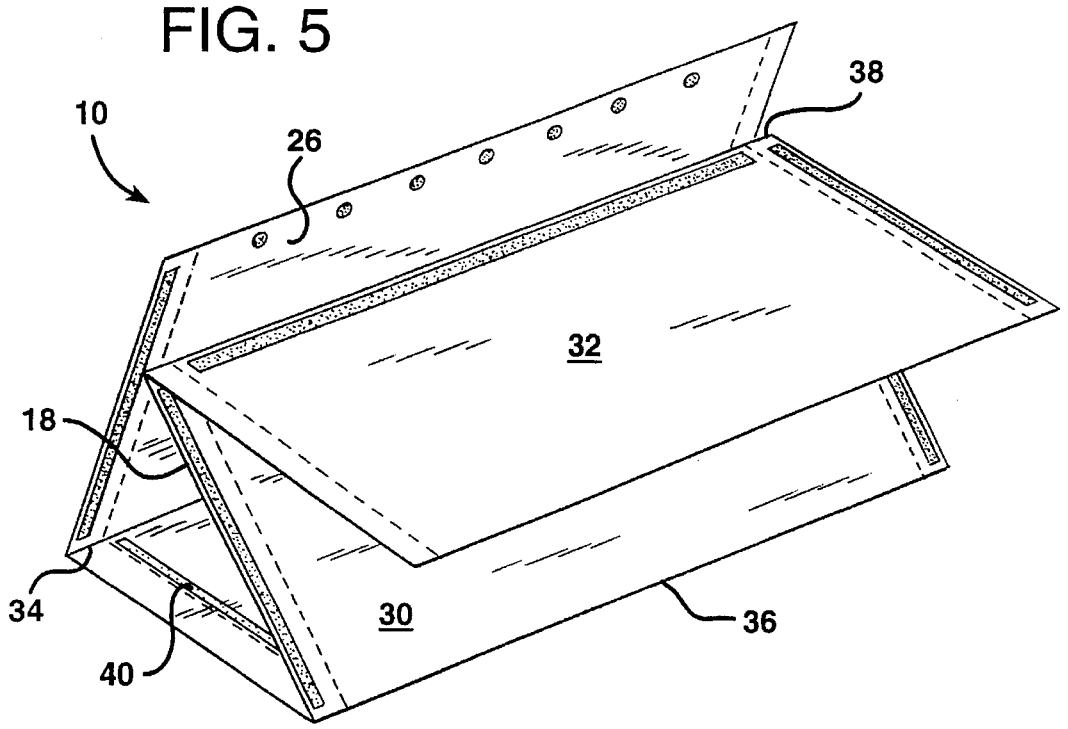
FIG. 5 is a perspective view of the mailer of FIGS. 1–4 folded about the first, second and third fold lines.

In order to secure the second fold of the double V-fold shown in FIG. 5, a third adhesive pattern 44 is provided on the first surface 14 of at least one of the third or fourth panels 30 and 32 or alternatively on the first surface 14 of at least one of the first and second panels 26 and 28. Preferably, third adhesive pattern 44 is disposed on both the third and fourth panels 30 and 32 or both the first and second panels 26 and 28. Third adhesive pattern 44 is provided adjacent both the first and second longitudinal edges 18 and 20. Third adhesive pattern 44 serves to secure either the first surface 14 of the third panel 30 to the first surface 14 of the fourth panel 32 or the first surface 14 of the second panel 28 to the first surface 14 of the first panel 26 when the mailer 10 is subjected to the second V fold as in FIG. 5.

The mailer 10 of the present invention also may include a transverse line of weakness 46 adjacent to either the first fold line 34 or the third fold line 38. This transverse line of weakness 46 then defines a closure flap 48 for the return envelope between the line of weakness 46 and the respective fold line. The closure flap 48 may be disposed either in the first or fourth panels 26 and 32 as in FIG. 1 or in the second or third panels 28 and 30 as in FIG. 10. The closure flap 48 is, thus, formed from only a portion of one of the first, second, third or fourth panels, 26, 28, 30 and 32 respectively, not the entire panel. A fourth adhesive pattern 50 is then provided on the second surface of the closure flap 48 to allow sealing of the reply envelope. Fourth adhesive pattern 50 may be a remoist adhesive or a pressure sensitive adhesive, both of which are well-known in the art. Of course, if a pressure sensitive adhesive is employed, a release liner (not shown) may be required to protect the adhesive 50.

The mailer 10 of the present invention includes space for the printing of various information, both variable and nonvariable, if so desired. By variable information, it is meant information which varies from mailer to mailer such as addressee information. By nonvariable information, it is meant information which remains the same from mailer to mailer. For instance, a return address may be included on either the second panel 28 or the third panel 30 of the return envelope. Further, an outgoing address may be included on either the first or fourth panels, 26 and 32, respectively. Pre-paid postage may be included on any of the panels for both the outgoing and return addresses.

To provide additional sealing of the mailer 10 when the mailer is double V-folded as in FIG. 5, a fifth adhesive pattern 52 may be preferably disposed on substrate sheet 12. The fifth adhesive pattern 52 may be provided on the second surface 16 adjacent to either the first or second end edges, 22 and 24 or on the first surface 14 adjacent the second fold line 36 in either the second panel 28 or the third panel 30. Preferably, the fifth adhesive pattern 52 is provided both adjacent to the first or second end edges 22 and 24 and adjacent the second fold line 36.

Any of the first adhesive pattern 40, the second adhesive pattern 42, the third adhesive pattern 44, or fifth adhesive patterns 52 may be various adhesives such as hot-melt adhesives, remoist adhesives, self-adhesives, and pressure sensitive adhesives, all of which are well-known in the art and need no further discussion. Of course, one of ordinary skill in the art will recognize that if a hot-melt or remoist adhesive is employed then a corresponding adhesive on the surface to which the adhesive is to adhere will not be required and that if a self-adhesive is employed then a corresponding adhesive pattern on the surface to which the adhesive is to adhere will be required.

In a preferred embodiment of the present invention, longitudinal lines of weakness 54 are provided adjacent both the first and second longitudinal edges, 18 and 20, creating tabs 56 therebetween. Longitudinal lines of weakness 54 extend from both opposing end edges, 22 and 24. In other words, lines of weakness 54 pass through all of the first, second, third and fourth panels, 26, 28, 30 and 32 respectively. When employing lines of weakness 54, first adhesive pattern is preferably to the inside of the lines 54 while the second and third adhesive patterns are to the outside or provided on tabs 56. By providing the adhesives in this manner, once the mailer 10 is folded and secured, the end user may simply remove tabs 56 by tearing along the lines of weakness 54. When the tabs 56 are then removed, the user will be able to open up the mailer with relative ease. Yet, the second and third panels, 28 and 30, will remain adhered to each other forming the return or reply envelope.

In an additional embodiment of the present invention, the mailer 10 may contain a two-ply card suitable for use as a membership card or other type of identification card. Lines of weakness 58 are disposed in first panel 26 thereby defining a first ply 60. Additionally, lines of weakness 62 are provided in fourth panel 32 thereby defining a second ply 64. A sixth adhesive pattern 66 is then provided on the second surface 16 of either the first ply 60 or the second ply 64 or on both. Sixth adhesive pattern 66 may be a hot-melt, remoist or a pressure sensitive adhesive, all of which are well-known in the art. Thus, when mailer 10 is folded first about the second fold line 36 as shown in FIG. 5, first ply and second ply contact each other. Preferably, the two-ply card is then laminated by any procedure known in the art such as, for example, the methods of U.S. Pat. No. 5,096,229 and U.S. Pat. No. 5,131,686, the disclosures of which are both herein incorporated by reference.

Figure 3:
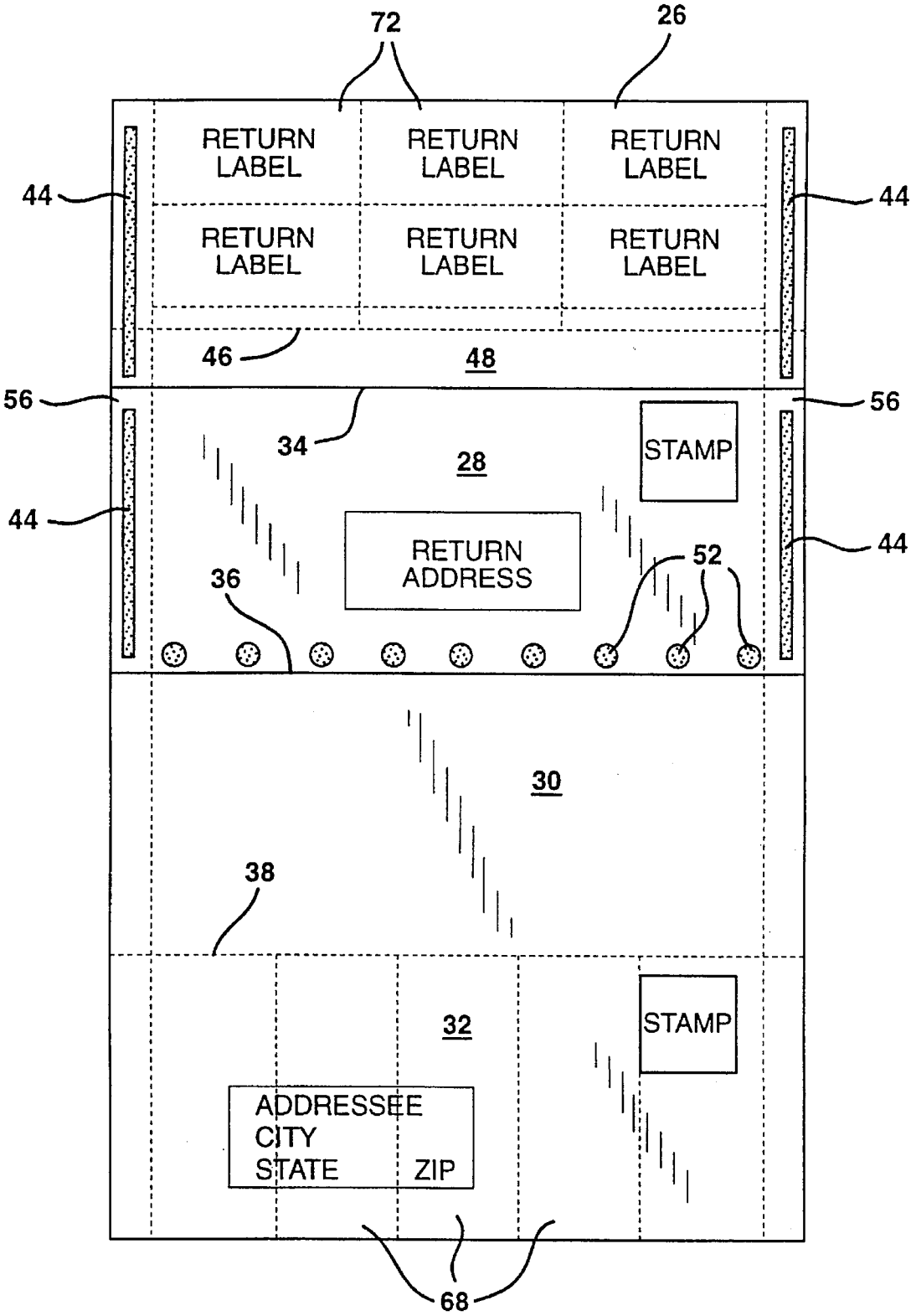
FIG. 3 is a plan view of the front (first) side of one embodiment of the mailer or business form intermediate of the present invention containing multiple partitions.
Figure 4:
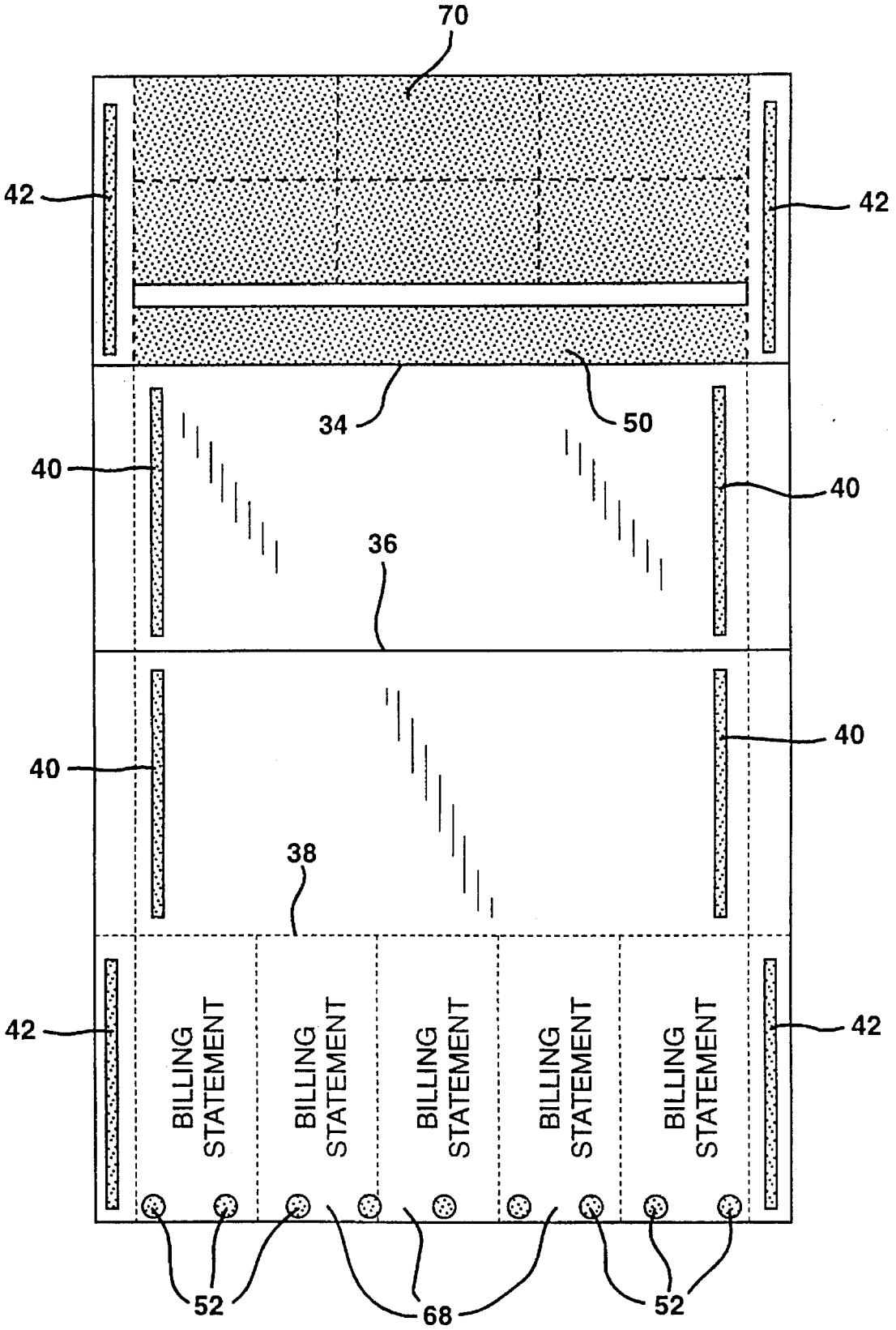
FIGS. 4 and 4A are plan views of the back (second) side of the embodiment shown in FIG. 3.
Figure 4A:
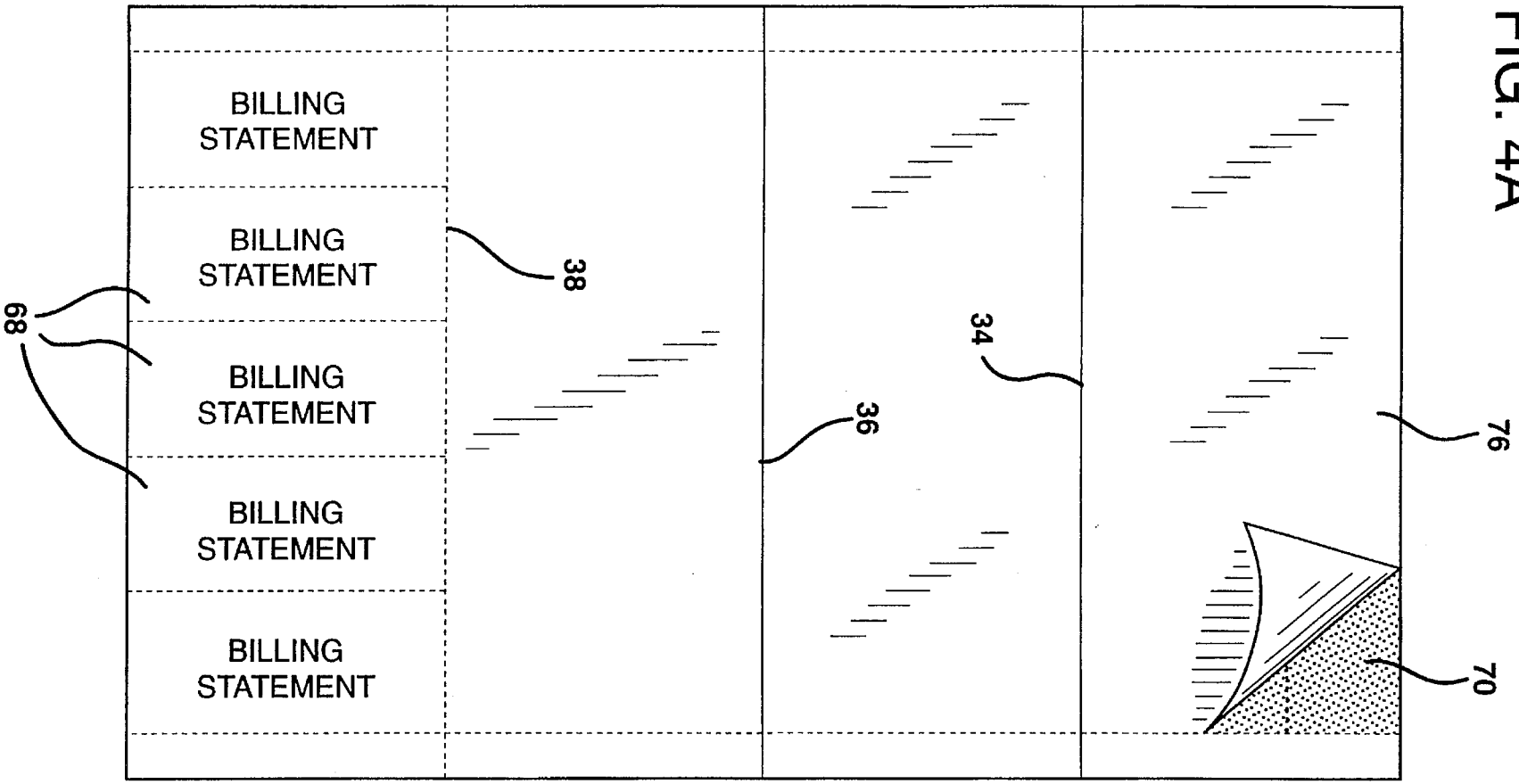

Turning now to FIGS. 3 and 4, there is seen a further embodiment of the present invention. In this embodiment, horizontal and vertical lines of weakness are included in any of the first, second, third or fourth panels, 26, 28, 30 and 32, thereby defining at least one section 68. Preferably, multiple sections 68 are provided in mailer 10. Various information may be included on the sections 68, such as billing statements, addresses, or product identifications. Thus, the end user merely needs to remove an individual section along the lines of weakness and enclose the section in the reply envelope to pay monthly bills or order goods and services. Preferably, a seventh adhesive pattern 70 is disposed on at least one of the sections 68 thereby defining a label 72. Seventh adhesive pattern 70 may be a remoist adhesive or a pressure sensitive adhesive, both of which are well-known in the art. Of course, if a pressure sensitive adhesive is employed, a release liner 76 as shown in FIG. 4A may be required to protect the adhesive 70.

Figure 6:
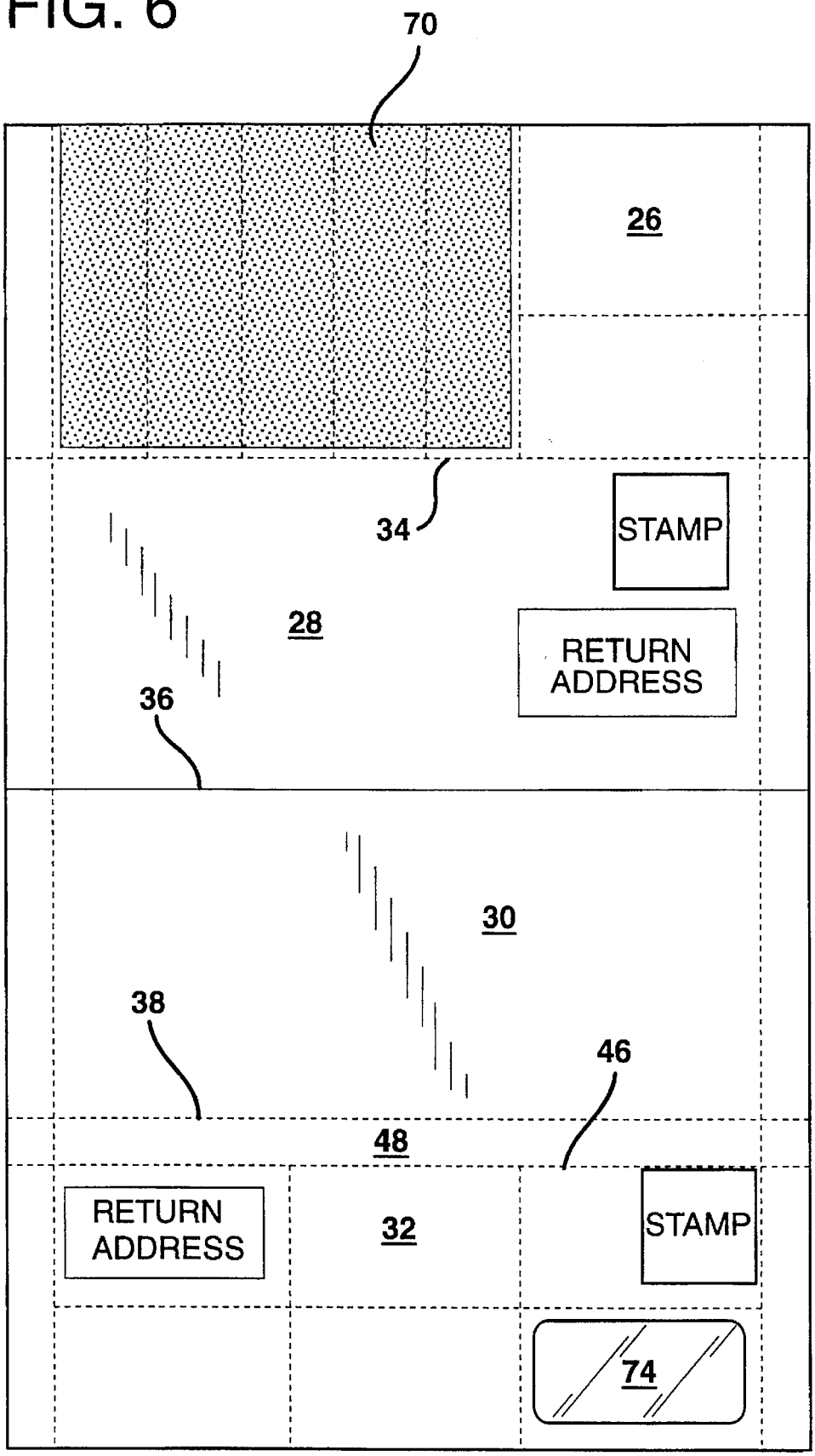
FIG. 6 is a plan view of the front (first) side of one embodiment of the mailer or business form intermediate of the present invention containing a return address window.
Figure 7:
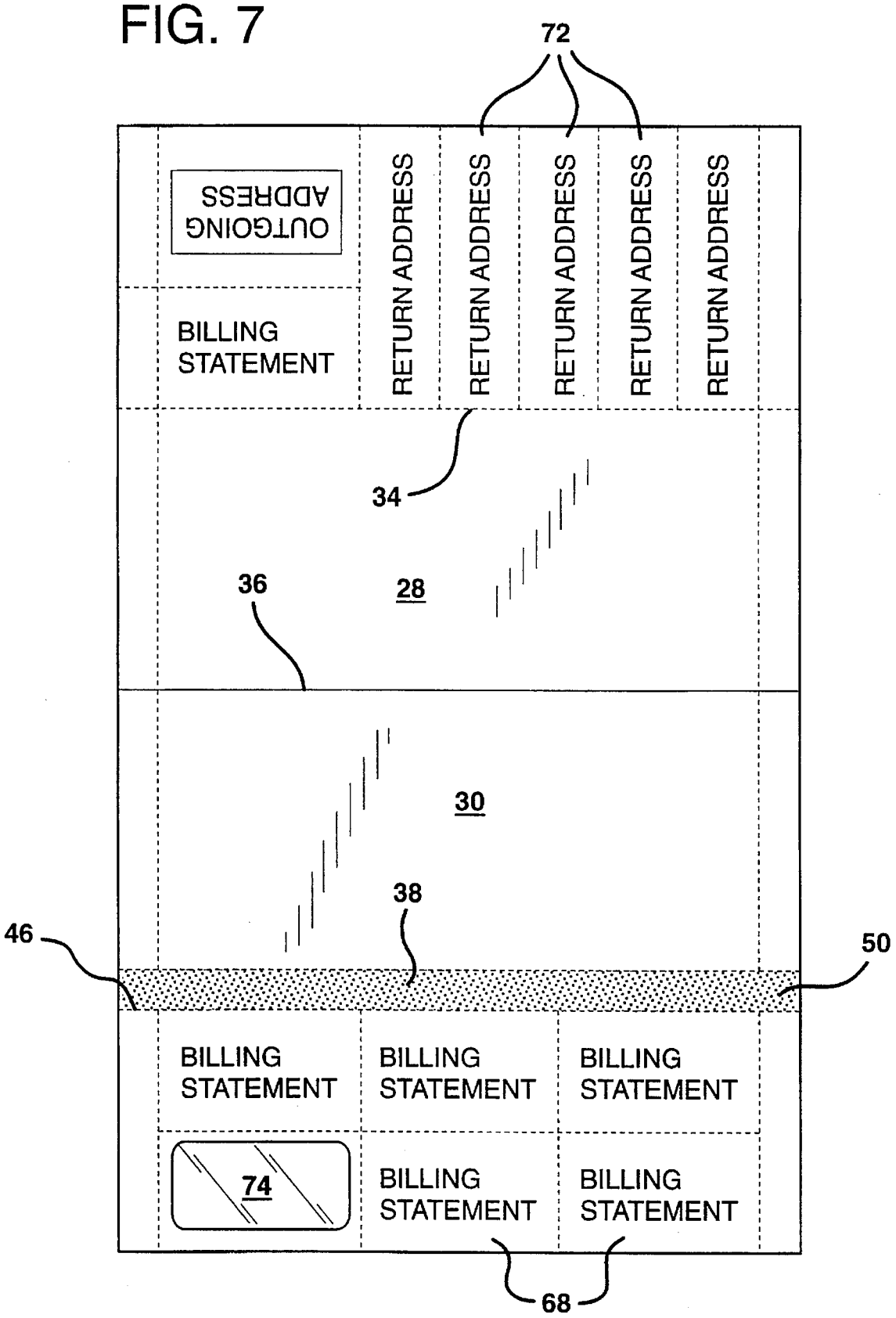
FIG. 7 is a plan view of the back (second) side of the embodiment shown in FIG. 6.

Turning now to FIGS. 6 and 7, there is seen an additional embodiment of the present invention. In this embodiment, an address window 74 is provided in the mailer 10. Although depicted in fourth panel 32, address window 74 may also be located in first panel 26. Address window 74 may simply be a cut-out opening in substrate 12 thereby allowing the outgoing address to be viewed or address window 74 may be covered by any of a number of clear plastic films well-known in the art which will allow the outgoing address to be viewed while protecting the substrate 12 underneath the plastic film. Additionally shown in FIGS. 6 and 7, is closure flap 48 being located in the fourth panel 32.

Referring to FIGS. 8–12, where like reference numerals represent like elements, there is seen another embodiment of the present invention. In this embodiment, first panel 26 is smaller in size than the second, third and fourth panels, 28, 30 and 32. Further, the return or reply envelope is formed from only a portion of the second and third panels 28 and 30.

Figure 12:
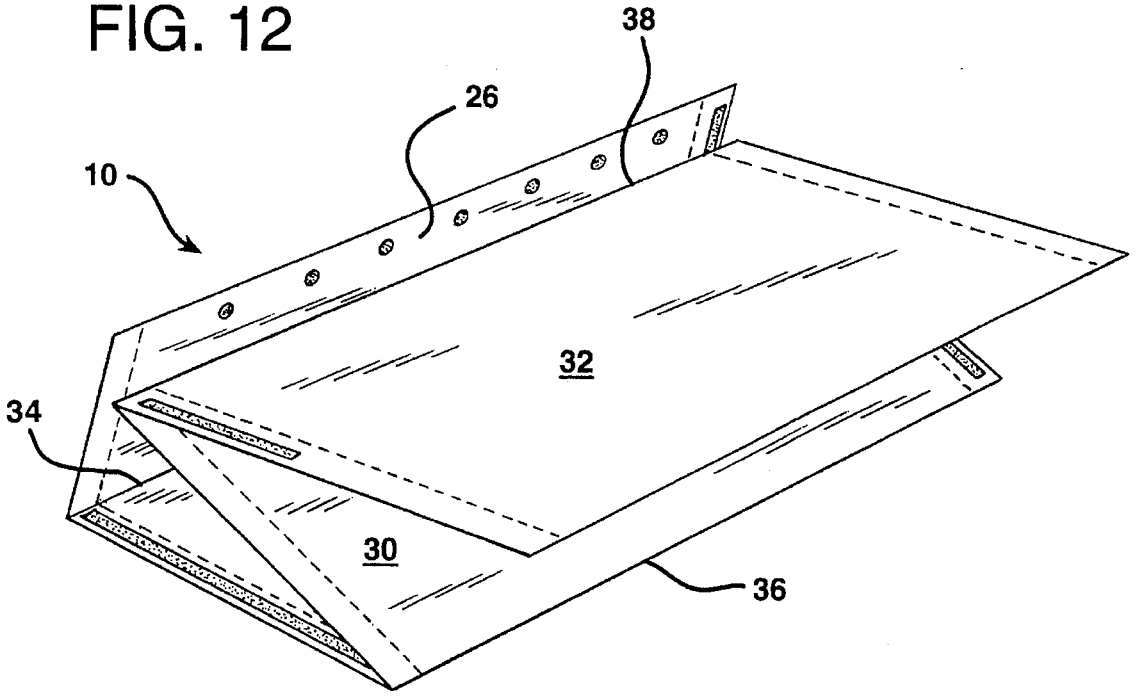
FIG. 12 is a perspective view of the embodiment of FIGS. 10–11 folded about the first, second and third fold lines.
Figure 8:
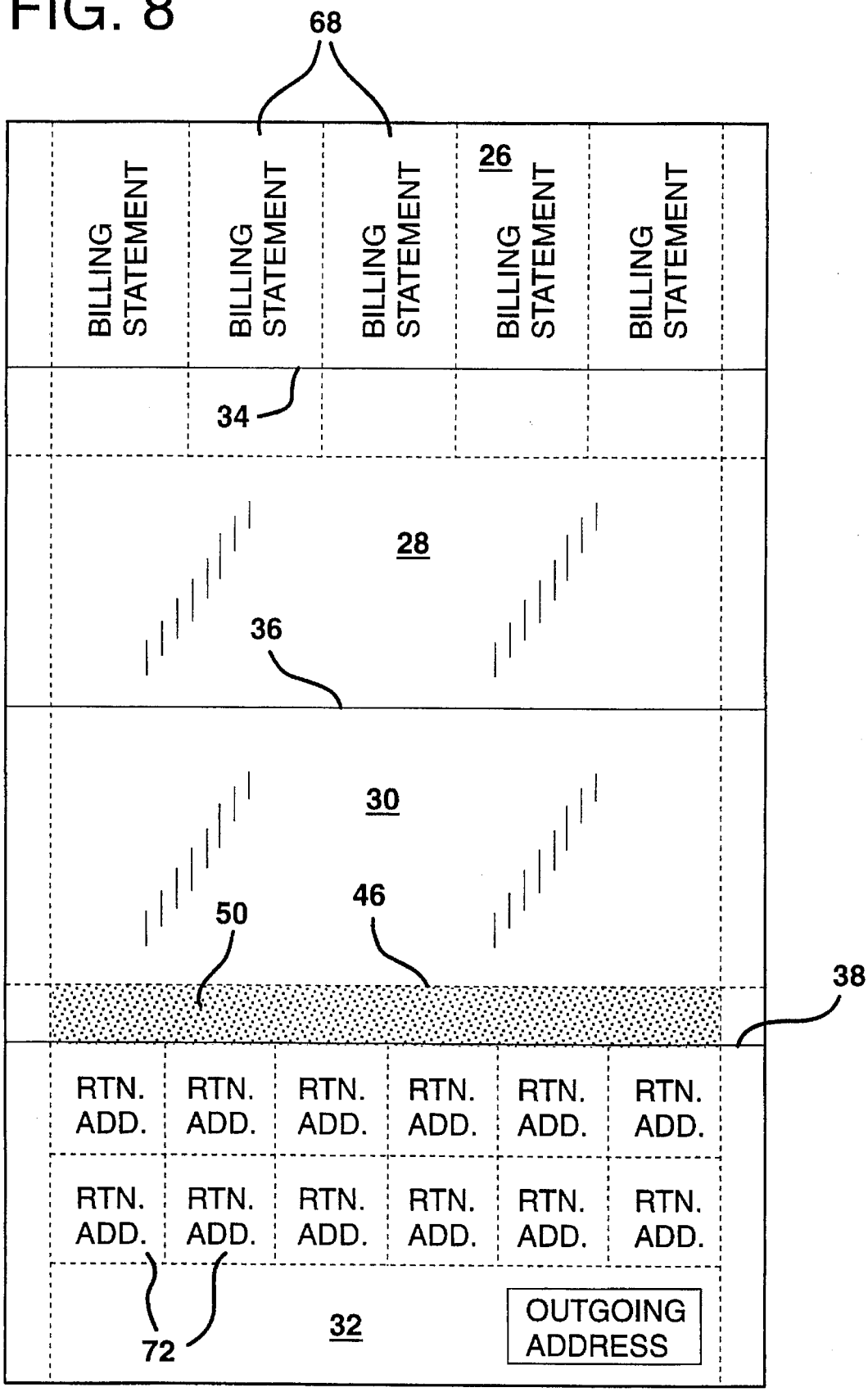
FIG. 8 is a plan view of the front side of one embodiment of the mailer or business form intermediate of the present invention containing a closure flap in the third panel.
Figure 9:
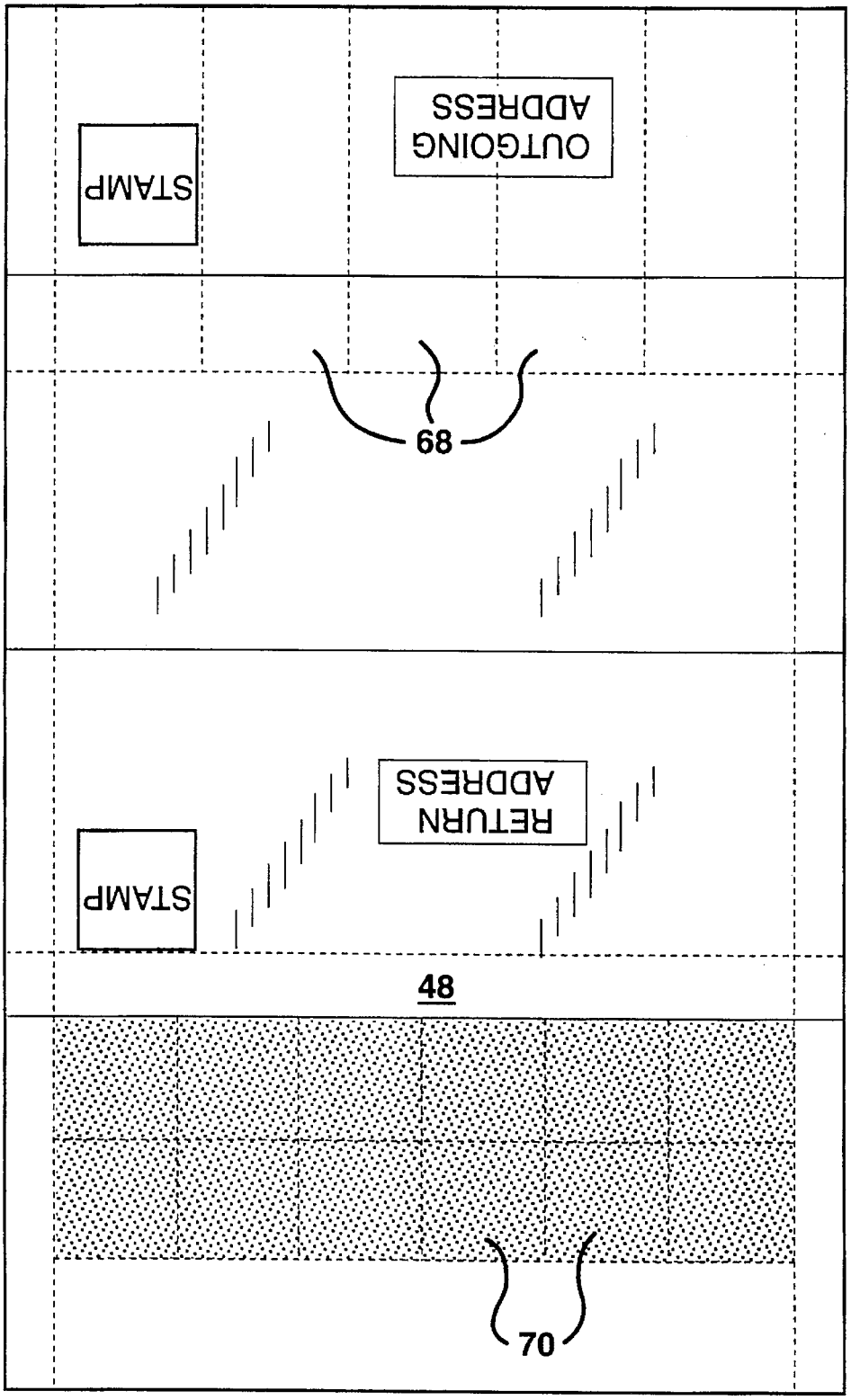
FIG. 9 is a plan view of the back side of the embodiment shown in FIG. 8.
Figure 11:
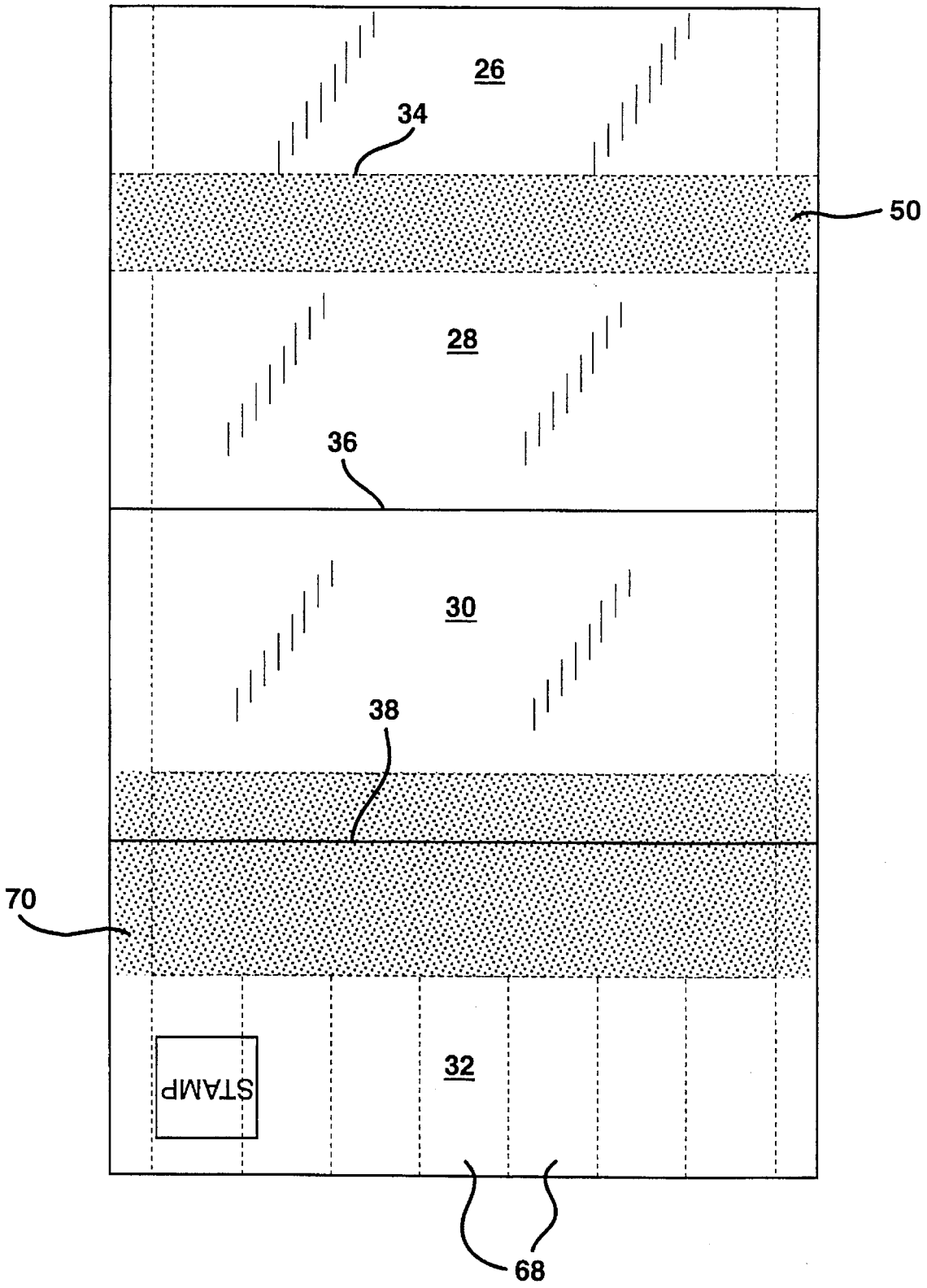
FIG. 11 is a plan view of the back side of the embodiment shown in FIG. 10.

In FIGS. 8 and 9, the remainder of third panel 30 is closure flap 48, while the remainder of second panel 28 includes lines of weakness for sections 68 which extend into first panel 26. In FIGS. 10 and 11, the remainder of second panel 28 is closure flap 48 while the remainder of third panel 30 are labels 72. FIG. 12 then depicts the folding of the mailer 10 of FIGS. 8–11.

Having described the invention in detail and by reference to the preferred embodiments thereof, it will be apparent that modifications and variations are possible without departing from the scope of the invention which is defined in the appended claims.

What is claimed is:

1. A mailer or business form intermediate adapted to be folded and mailed comprising:

a substrate sheet having first and second surfaces, first and second opposite parallel longitudinal edges, and first and second opposite end edges;

first, second and third transverse fold lines formed in said substrate perpendicular to said parallel longitudinal edges, dividing said substrate into first, second, third, and fourth panels, said first fold line separating said first and second panels, said second fold line separating said second and third panels, said third fold line separating said third and fourth panels, said second, third and at least one of said first and fourth panels having substantially the same longitudinal dimensions, said second and third panels having an absence of transverse lines of weakness adjacent to said second fold line;

a first adhesive pattern provided on said second surface of at least one of said second and third panels adjacent said longitudinal edges, a second adhesive pattern provided on said second surface of at least one of said first and fourth panels adjacent said longitudinal edges, a third adhesive pattern on said first surface of at least one of said first, second, third and fourth panels so that when said substrate is folded first about said second fold line then about said first and third fold lines said second surfaces of said second and third panels lie in contact forming a reply envelope, and said second surfaces of said first and fourth panels lie in contact;

a transverse line of weakness adjacent to and extending parallel to said first or third fold lines thereby defining a return envelope closure flap; and a fourth adhesive pattern disposed on said closure flap.

2. The mailer intermediate as claimed in claim 1 further including a fifth adhesive pattern disposed on said second surface adjacent said first end edge.

3. The mailer intermediate as claimed in claim 1 further including lines of weakness in said first, second, third and fourth panels adjacent both of said first and second longitudinal edges.

4. The mailer intermediate as claimed in claim 1 further including horizontal lines of weakness, vertical lines of weakness or both in any of said first, second, third or fourth panels thereby defining multiple partitions.

5. The mailer intermediate as claimed in claim 4 further including a adhesive pattern disposed on at least one of said partitions thereby defining a label.

6. The mailer intermediate as claimed in claim 5 wherein said adhesive pattern is a pressure sensitive adhesive and is protected by a release liner.

7. The mailer intermediate as claimed in claim 5 wherein said adhesive pattern is a remoist adhesive.

8. The mailer intermediate as claimed in claim 1 wherein said fourth adhesive pattern is a remoist adhesive.

9. The mailer intermediate as claimed in claim 1 wherein said first, second and third adhesive patterns are self-adhesives.

10. The mailer intermediate as claimed in claim 1 wherein said transverse line of weakness defining said closure flap is disposed in said first panel.

11. The mailer intermediate as claimed in claim 1 wherein when said substrate is folded, said first surface of said first panel lies in contact with said first surface of said second panel.

12. The mailer intermediate as claimed in claim 1 further including a fifth adhesive pattern disposed on said second surface adjacent said second end edge.

* * * * *